US008149180B2

(12) United States Patent
Thevenot et al.

(10) Patent No.: US 8,149,180 B2
(45) Date of Patent: Apr. 3, 2012

(54) ANTENNA WITH RESONATOR HAVING A FILTERING COATING AND SYSTEM INCLUDING SUCH ANTENNA

(75) Inventors: Marc Thevenot, Rilhac Rancon (FR); Bernard Jecko, Rilhac Rancon (FR); Thierry Monediere, Limoges (FR); Regis Chantalat, Naves (FR); Cyrille Menudier, St Julien le Petit (FR); Patrick Dumon, Vigoulet-Auzil (FR)

(73) Assignees: Centre National de la Recherche Scientifique (C.N.R.S.), Paris (FR); Centre National d'Etudes Spatiales, Paris (FR); Universite de Limoges, Limoges (FR)

( * ) Notice: Subject to any disclaimer, the term of this patent is extended or adjusted under 35 U.S.C. 154(b) by 247 days.

(21) Appl. No.: 12/593,520

(22) PCT Filed: Mar. 13, 2008

(86) PCT No.: PCT/FR2008/050426

§ 371 (c)(1),
(2), (4) Date: Mar. 9, 2010

(87) PCT Pub. No.: WO2008/135677

PCT Pub. Date: Nov. 13, 2008

(65) Prior Publication Data

US 2010/0321261 A1 Dec. 23, 2010

(30) Foreign Application Priority Data

Mar. 29, 2007 (FR) ..... 07 02305

(51) Int. Cl.
*H01Q 15/02* (2006.01)

(52) U.S. Cl. ..... 343/909; 343/775

(58) Field of Classification Search ..... 343/909, 343/700 MS, 772, 775, 776, 731, 779
See application file for complete search history.

(56) References Cited

U.S. PATENT DOCUMENTS

| | | | | |
|---|---|---|---|---|
| 6,549,172 | B1 * | 4/2003 | Thevenot et al. | 343/756 |
| 7,855,689 | B2 * | 12/2010 | Fukui et al. | 343/731 |
| 2006/0097917 | A1 * | 5/2006 | Thevenot et al. | 343/700 MS |
| 2006/0132378 | A1 | 6/2006 | Thevenot et al. | |

FOREIGN PATENT DOCUMENTS

| | | |
|---|---|---|
| EP | 1145379 | 10/2001 |
| EP | 1387437 | 2/2004 |
| FR | 2801428 | 5/2001 |
| WO | 0137373 | 5/2001 |

OTHER PUBLICATIONS

Thevenot et al.: "Directive Photonic-Bandgap Antennas", IEEE Transactions on Microwave Theory and Techniquies, IEEE Service Center, Piscataway, NJ, US, vol. 47, No. 11, Nov. 1999, XP01103778.
International Search Report dated Sep. 19, 2008 in PCT application.

* cited by examiner

*Primary Examiner* — Hoanganh Le
(74) *Attorney, Agent, or Firm* — Young & Thompson

(57) ABSTRACT

The invention relates to an antenna for transmitting or receiving electromagnetic waves at a working frequency $f_T$, that comprises a resonator with a filtering (49) coating that covers the major portion of the upper face of a reflector (22) located inside a cavity (36), the coating (40) being capable of removing all the electromagnetic waves having a frequency $f_T$, and propagating in a direction parallel to the upper face of the reflector, without removing all the electromagnetic waves having a frequency $f_T$ and propagating in a direction perpendicular to the upper face of the reflector.

15 Claims, 8 Drawing Sheets

Figure 1:
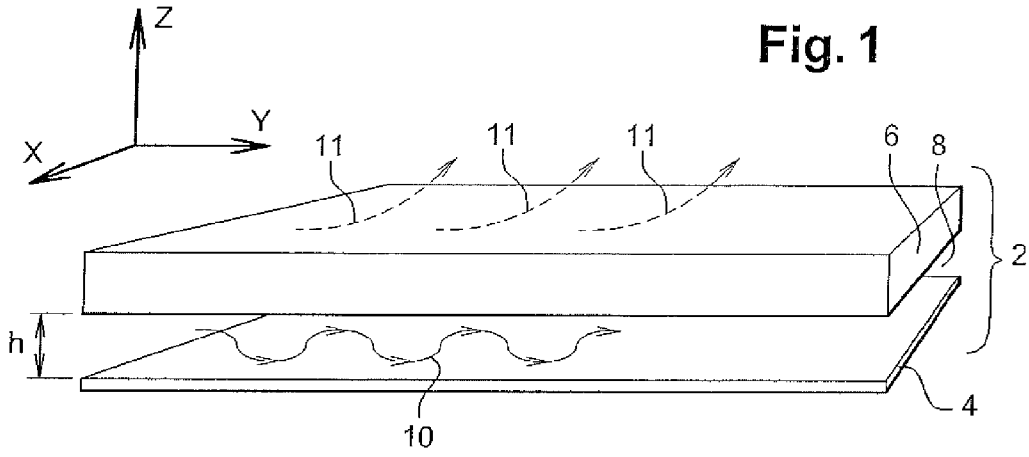

ANTENNA WITH RESONATOR HAVING A FILTERING COATING AND SYSTEM INCLUDING SUCH ANTENNA

This invention concerns an antenna with resonator equipped with a filtering coating, and a system incorporating this antenna.

Known antennas are designed to emit or receive electromagnetic waves with a working frequency $f_T$. These antennas can include a first resonator formed of:

- a reflector reflecting all the electromagnetic waves at frequency $f_T$ which are propagated perpendicularly to this reflector,
- a partly reflecting wall, through which the electromagnetic waves at frequency $f_T$ pass, this wall reflecting strictly less than 100% and more than 80% of the electromagnetic waves at frequency $f_T$ which are propagated perpendicularly to this wall,
- a cavity which is delimited on one side by an upper face of the reflector, and on the other side by a lower face of the partly reflecting wall, and
- at least one excitation probe for the cavity, suitable for receiving or injecting into this cavity, at the reflector, electromagnetic fields at frequency $f_T$.

It should be remembered here that the coefficient of reflection of a wall or reflector depends on the angle of incidence, the frequency of the electromagnetic wave and the polarisation of this electromagnetic wave. Here, the reflectivity values of the walls or reflectors are given for the following situation:

- the frequency of the electromagnetic wave equals the working frequency $f_T$,
- the angle of incidence is zero, i.e. the electromagnetic wave is propagated perpendicularly to the wall or reflector, and
- the polarisation which is taken into account is that of the electrical field which the excitation probe radiates or receives.

For example, such antennas are described in the specific case of antennas of PBG (photonic band gap) material with defect, in the patent application filed under number FR 99 14521.

These antennas have a reduced space requirement and strong directivity. The radiation pattern of these antennas therefore has a significant main lobe and secondary lobes.

The invention is aimed at reducing the significance and size of the secondary lobes.

An object of the invention is therefore an antenna in which the first resonator includes a filtering coating which covers the majority of the upper face of the reflector within the cavity, this coating being suitable for eliminating all electromagnetic waves of frequency $f_T$ which are propagated in a parallel direction to the upper face of the reflector, but without eliminating all electromagnetic waves at frequency $f_T$ which are propagated in a perpendicular direction to the upper face of the reflector.

In the above antenna, the coating prevents the establishment of a guided mode in a parallel direction to the reflector. The effect of this is a significant improvement of the performance of the antenna.

The embodiments of this antenna can include one or more of the following characteristics:

- the filtering coating forms a PBG material which includes at least a first and a second substance, which differ in their permittivity and/or permeability and/or conductivity, and are arranged alternately at regular intervals only along one or more parallel directions to the upper face of the reflector, the regular interval being a function of the wavelength $\lambda_1$ of the electromagnetic waves of frequency $f_T$ in the first substance, in such a way as to eliminate the electromagnetic waves of frequency $f_T$ which are propagated parallel to the upper face of the reflector;
- the first substance forming the filtering coating is identical to the substance which fills the cavity;
- the second substance forming the coating is identical to the substance forming the upper face of the reflector;
- the second substance forms studs, of which the greatest width extends in a perpendicular direction to the upper face of the reflector, these studs being distributed at regular intervals on the upper face of the reflector, in two directions which are non-colinear and parallel to this upper face, the greatest width being strictly less than $\lambda_1/2$, where $\lambda_1$ is the wavelength of the electromagnetic waves of frequency $f_T$ in the first substance;
- the upper face of the reflector and the lower face of the partly reflecting wall are separated from each other by a height $h_1$ which is constant and strictly less than or equal to $\lambda_2/2$, where $\lambda_2$ is the wavelength of the electromagnetic waves of frequency $f_T$ in the substance which fills the cavity;
- the partly reflecting wall is a grating formed of multiple parallel metallic bars, the shortest distance between two contiguous parallel bars being strictly less than $\lambda_3/2$, where $\lambda_3$ is the wavelength of the electromagnetic waves of frequency $f_T$ in air;
- the partly reflecting wall is a PBG material which includes at least two substances, which differ in their permittivity and/or permeability and/or conductivity, and are arranged alternately at least along a perpendicular direction to the upper face of the reflector, one of these two substances being the same as that which fills the cavity;
- the antenna includes a second resonator formed of:
  - a radiating wall, through which electromagnetic waves pass at frequency $f_T$, and having a radiating outer face, this radiating wall reflecting strictly less than 100% and more than 80% of the electromagnetic waves at frequency $f_T$ which are propagated perpendicularly to this radiating wall, the reflectivity of the radiating wall being strictly less than that of the partly reflecting wall,
  - a leaking resonating cavity, delimited on one side by a lower face of the radiating wall, and on the other side by an upper face of the partly reflecting wall of the first resonator, the radiating wall and the partly reflecting wall being separated from each other by a height $h_2$ which is constant and less than or equal to $\lambda_4/2 + \lambda_4/20$, where $\lambda_4$ is the wavelength of the electromagnetic waves of frequency $f_T$ in the substance which fills the leaking resonating cavity;
- the antenna includes multiple excitation probes in the first resonator, each causing the formation of an excitation patch on the upper face of the partly reflecting wall, each excitation patch in its turn creating a radiating patch on the radiating face of the radiating wall, each excitation patch and radiating patch being defined as being the zone of the upper face of the partly reflecting wall and radiating wall respectively, located around a point of this face where the intensity of the electromagnetic field emitted by this probe is maximum, and including all the points of this face where the intensity of the electromagnetic field emitted by this probe is greater than or equal to half this maximum intensity, and in which the distance separating two contiguous excitation probes is chosen to be sufficiently small for the radiating patches created by these probes to overlap partly;

each excitation probe has a surface for injection and/or reception of electromagnetic waves at frequency $f_T$, the greatest width of which is greater than or equal to $\lambda_2$, the power distribution of the electromagnetic waves on the injection surface and/or reception surface having a point at which the power is maximum, this point being distant from the periphery of this surface, and the power decreases continuously along a straight line going from this point to the periphery, irrespective of the direction of the straight line considered in the plane of this surface, $\lambda_2$ being the wavelength of the electromagnetic waves of frequency $f_T$ in the substance which fills the cavity of the first resonator;

the height $h_2$ is given by the following relation:

$$h_2 = (2n\pi + \varphi_1 + \varphi_2)\frac{\lambda_4}{4\pi}$$

where:

n is the positive or negative integer which makes it possible to obtain the smallest positive height $h_2$, $\phi_1$ is the phase shift which is introduced between an incident electromagnetic wave at frequency $f_T$ and the reflected wave after reflection on the upper face of the partly reflecting wall of the first resonator, $\phi_2$ is the phase shift which is introduced between an incident electromagnetic wave at frequency $f_T$ and the reflected wave after reflection on the lower face of the radiating wall, $\lambda_4$ is the wavelength of the electromagnetic wave of frequency $f_T$ in the substance which fills the leaking resonant cavity;

the upper face of the reflector and the lower face of the partly reflecting wall are separated from each other by a height $h_1$ which is constant and strictly less than or equal to $\lambda_2/2$, where $\lambda_2$ is the wavelength of the electromagnetic waves of frequency $f_T$ in the substance which fills the cavity of the first resonator;

the cavity of the first resonator forms a waveguide, which has a cutoff frequency $f_c$ of the propagation mode $ET_1$, or $MT_1$, and an asymptotic value C above which no propagation mode EMT can be established, and in which the frequency $f_T$ is less than or equal to the frequency $f_c$ and greater than or equal to the asymptotic value C.

Embodiments of the antenna also have the following advantages:

using a PBG material to form the filtering coating makes it possible to increase the directivity of the antenna, choosing one of the substances of the PBG material which forms the filtering coating to be identical to that which fills the cavity avoids reflections at the interface between the cavity and the filtering coating, choosing one of the substances of the filtering coating to be identical to that which forms the upper face of the reflector makes it possible to eliminate effectively the surface waves of frequency $f_T$ which are propagated on the surface of the reflector, the effect of choosing the height $h_1$ to be less than or equal to $\lambda_2/2$ is that the frequency $f_T$ is less than the cutoff frequency of the fundamental propagation modes $ET_1$ and $MT_1$, which prevents the appearance of these guided propagation modes, and its final effect is to increase the directivity of the antenna without causing misalignment of the antenna, using a grating to form the partly reflecting wall limits the space requirement of the antenna and simplifies its design, using a PBG material to form the partly reflecting wall increases the directivity of the antenna, using the first resonator as the excitation source of a second resonator makes it possible to excite this second resonator without modifying the reflectivity of the walls of the leaking resonant cavity by the presence of openings or metallic parts to introduce a magnetic field into this cavity, overlapping the radiating patches makes it possible to implement a multi-beam antenna in which the different beams are interlaced, using excitation probes of which the greatest width is greater than or equal to the wavelength of the electromagnetic waves at frequency $f_T$ makes it possible to increase the directivity and gain of the antenna or of each beam of the antenna; also, when these excitation probes are used in an antenna which includes the first and second resonators, this makes it possible to obtain the above-mentioned advantages while retaining the reflectivity of the upper face of the unchanged partly reflecting wall, choosing the height $h_2$ as defined in the above formula makes it possible to increase the directivity of the antenna, choosing the height $h_2$ to be strictly less than $\lambda_2/2$ makes it possible to avoid overlapping the excitation patches, and choosing the working frequency $f_T$ to be less than or equal to the cutoff frequency $f_c$ and greater than or equal to the value C makes it possible to increase the directivity of the antenna very sensitively.

Another object of the invention is a system for emitting or receiving electromagnetic waves, including:

a focusing device, which is capable of focusing the electromagnetic waves which the system emits or receives onto a focal point, and the above antenna, placed on this focal point.

In the above system, use of the claimed antenna makes it possible to increase the efficiency of this system by lighting the greatest possible surface of the focusing device, while reducing the losses caused by overflow beyond the contour of this focusing device.

Figure 2:
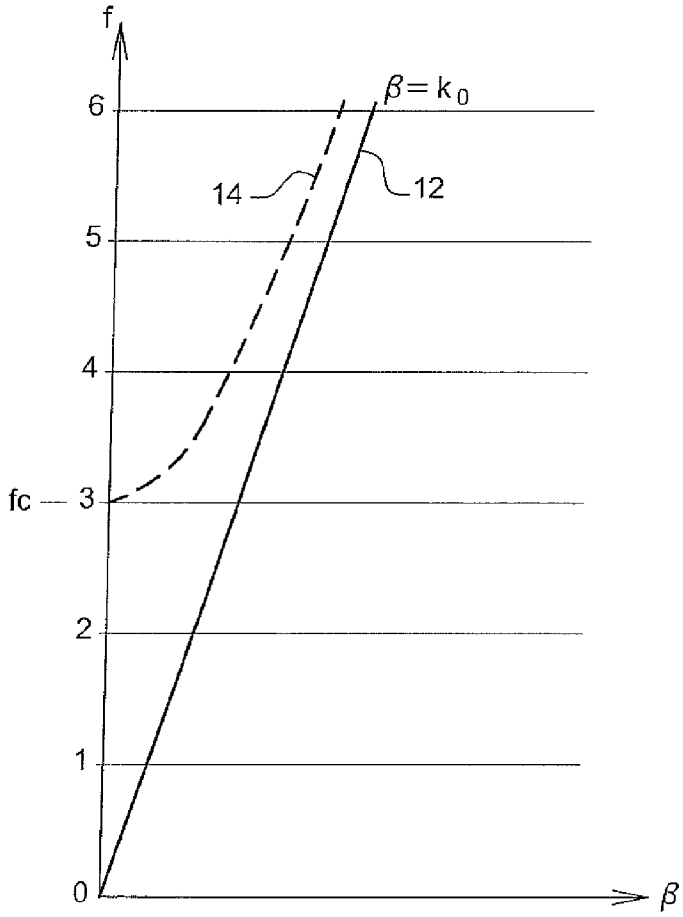
Figure 3:
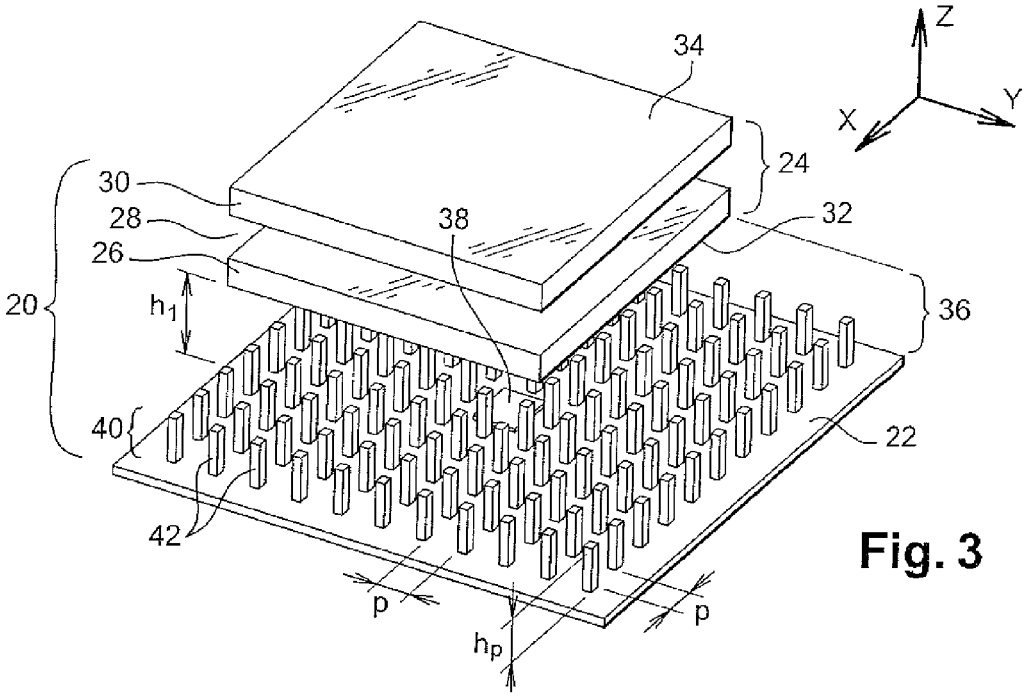
Figure 4:
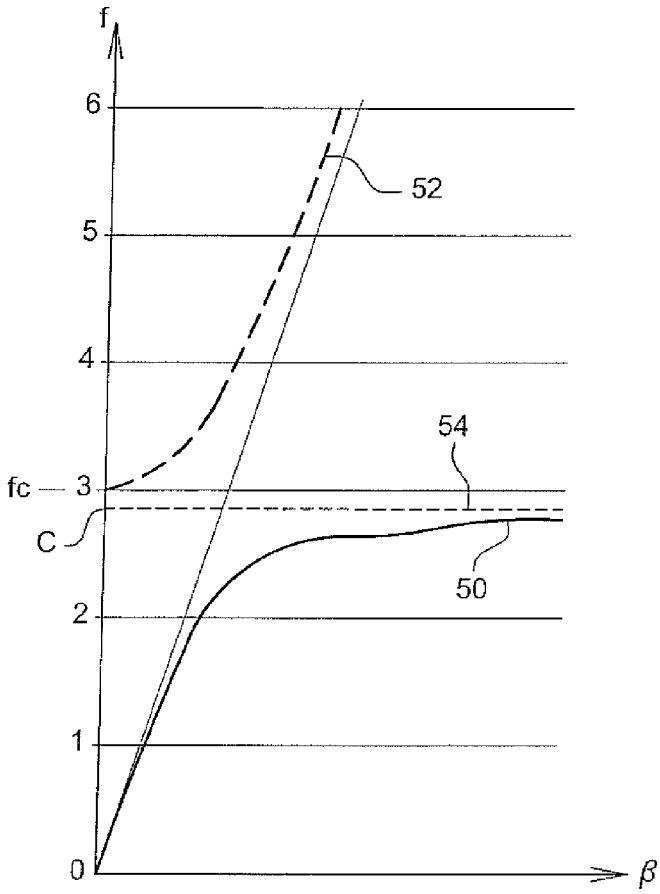
Figure 5:
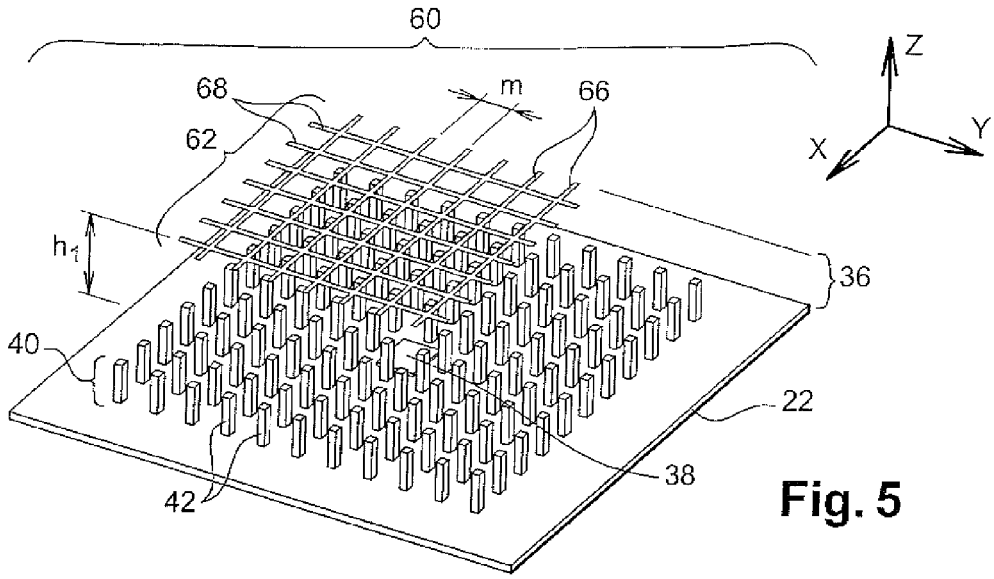
Figure 6:
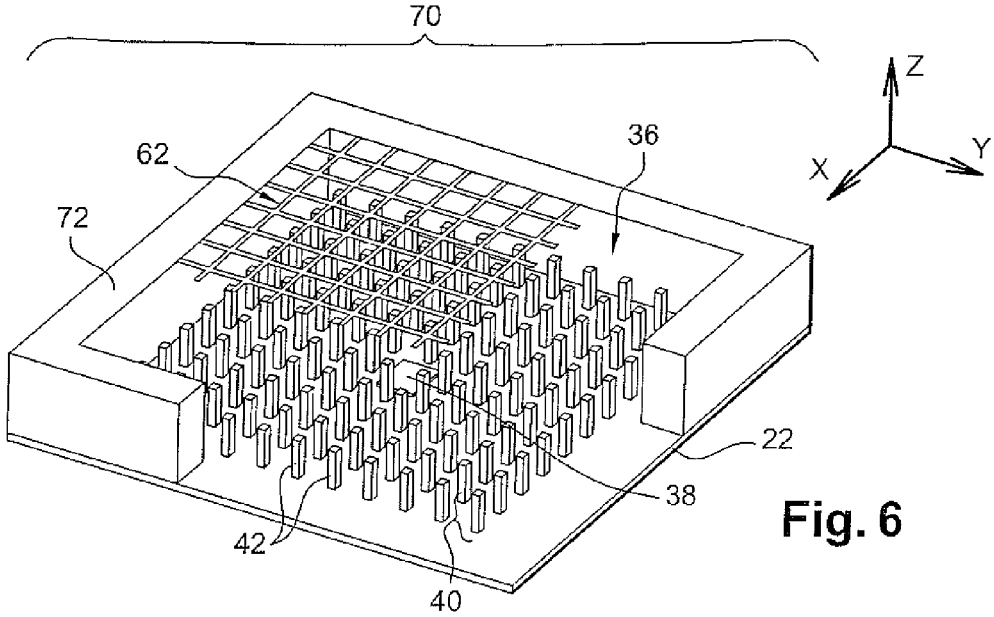
Figure 7:
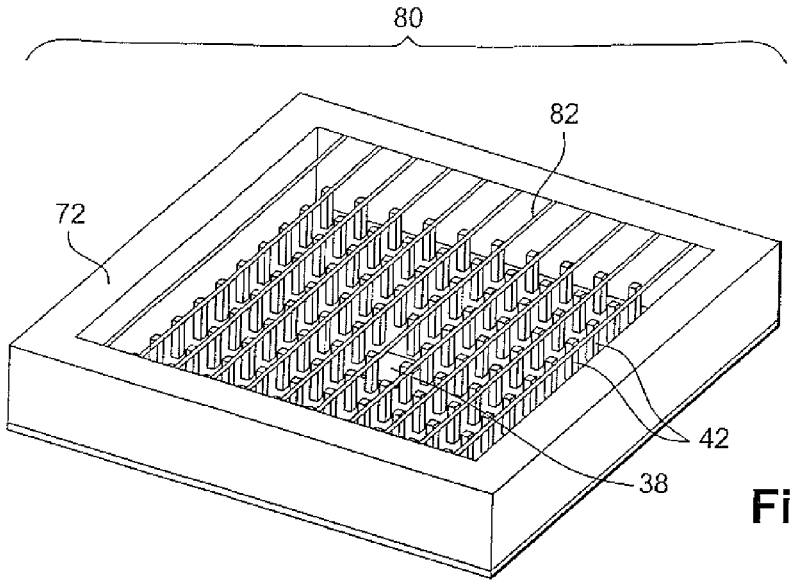
Figure 8:
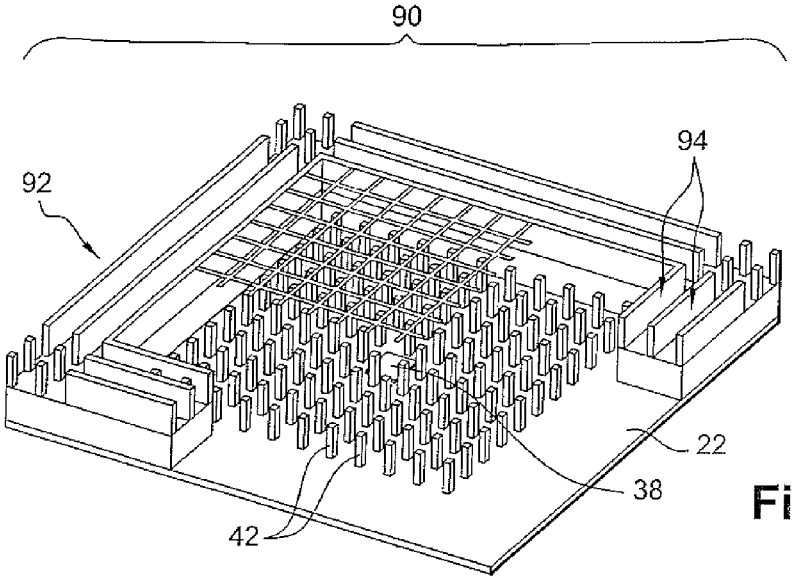
Figure 9:
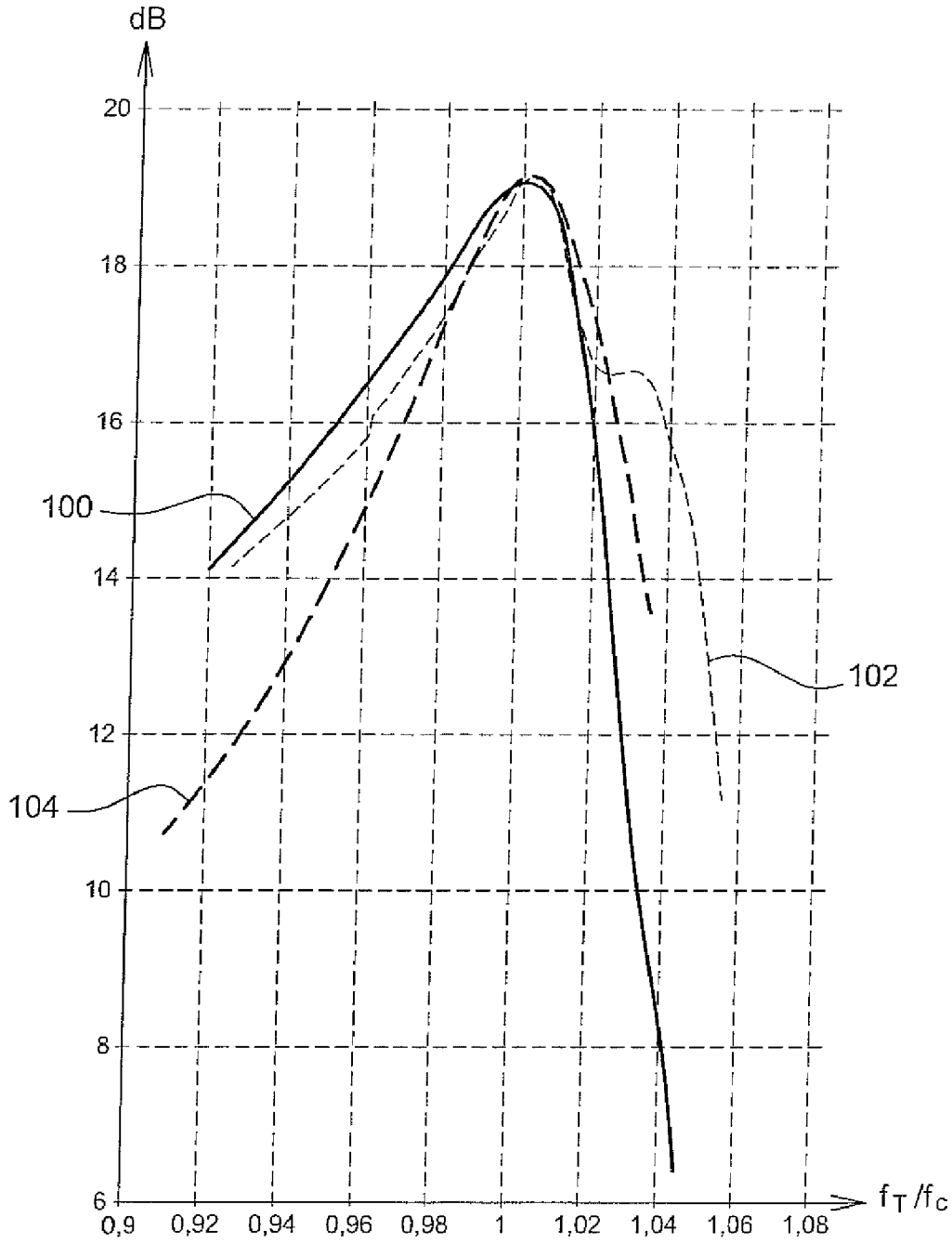
Figure 10:
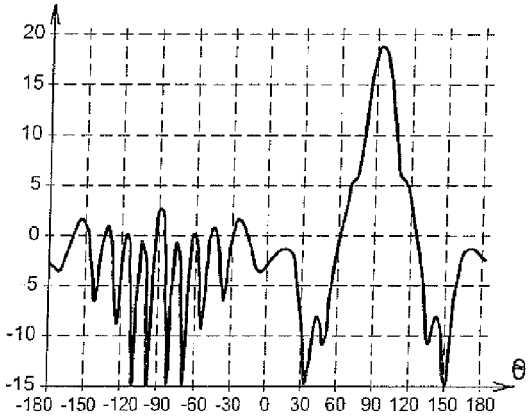
Figure 11:
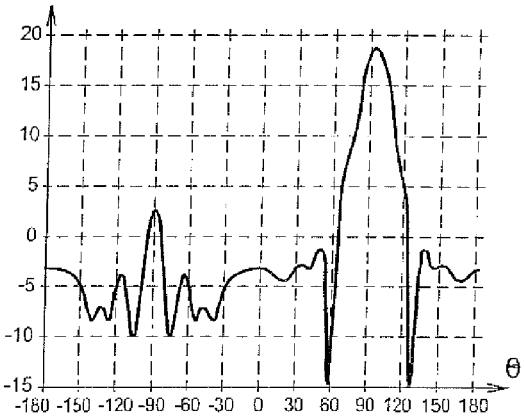
Figure 12:
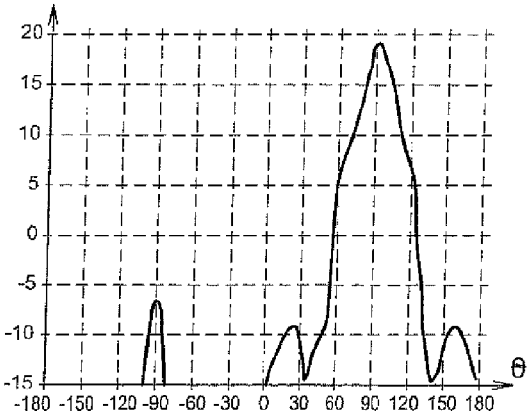
Figure 13:
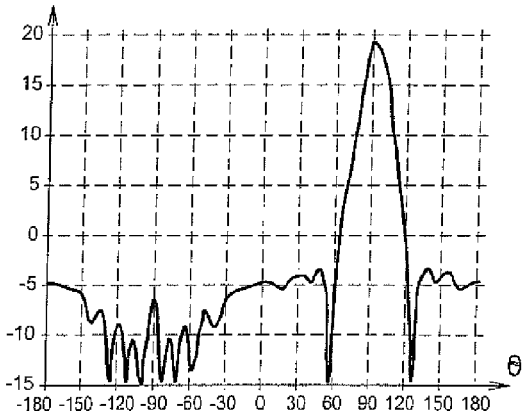
Figure 14:
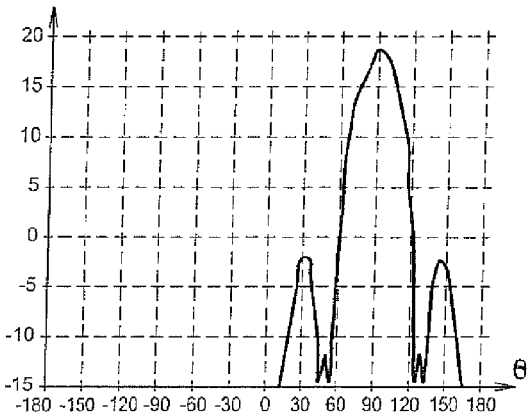
Figure 15:
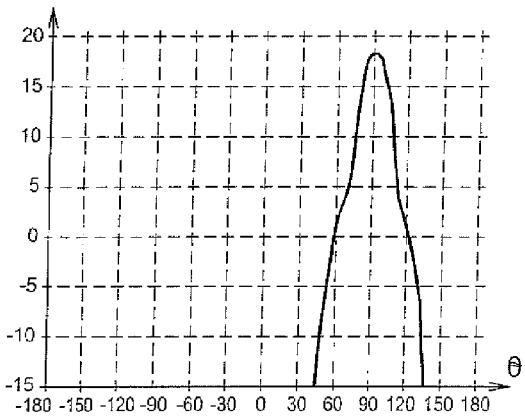
Figure 16:
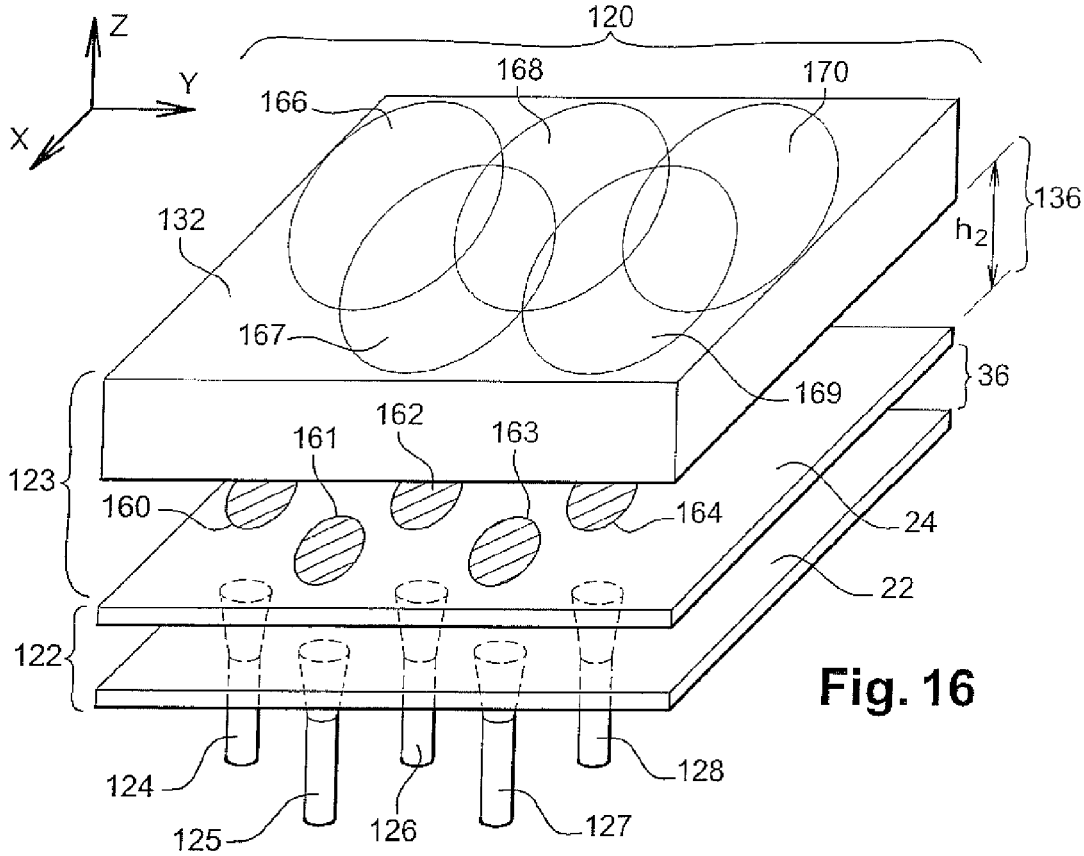
Figure 17:
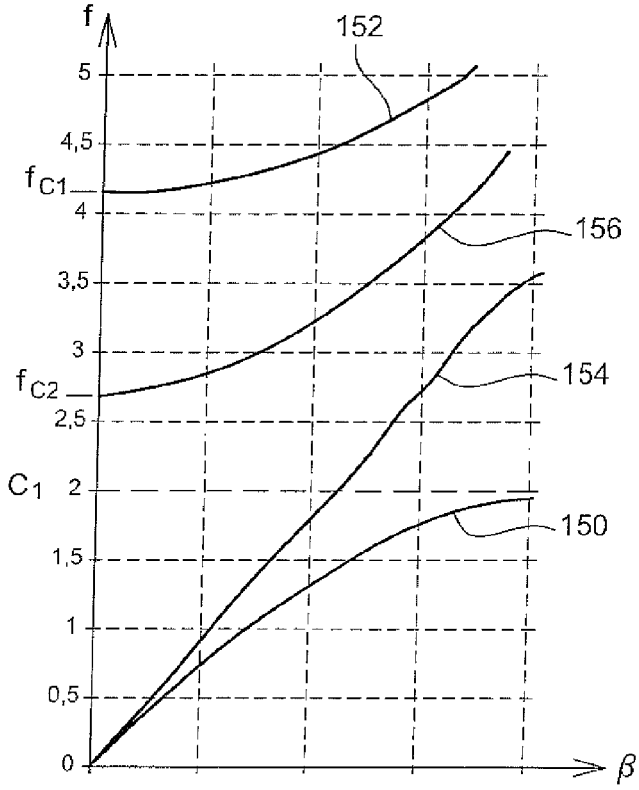
Figure 18:
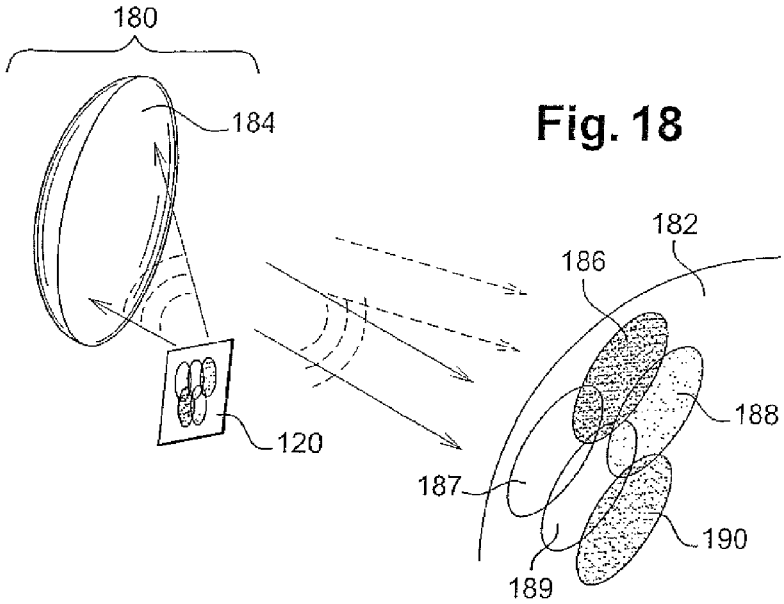
Figure 19:
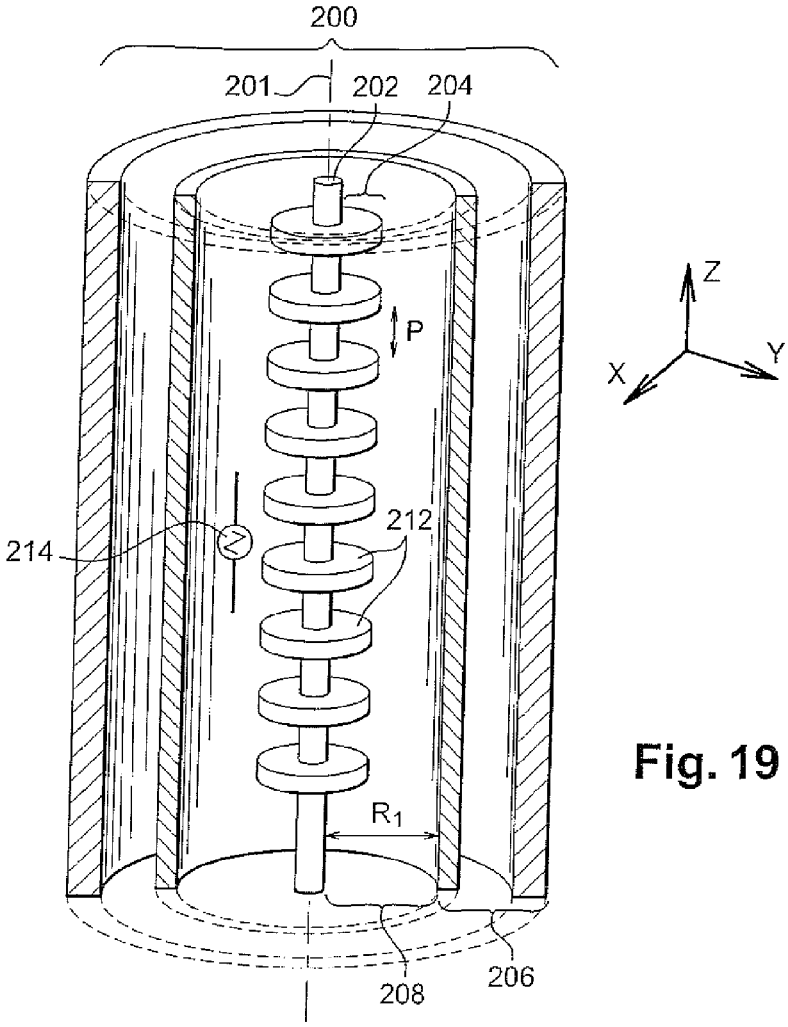

The invention will be better understood by reading the following description, which is given only as a non-limiting example, and which refers to the drawings, in which:

FIG. 1 is a schematic illustration of a flat waveguide,

FIG. 2 is a dispersion diagram of the guided propagation modes of the waveguide of FIG. 1, FIG. 3 is a schematic perspective illustration of a first embodiment of a an antenna equipped with a filtering coating which is implemented on the basis of a PBG material, FIG. 4 is a dispersion diagram of the guided propagation modes of the antenna of FIG. 3, FIG. 5 is a schematic perspective illustration of a second embodiment of an antenna equipped with a filtering coating, FIGS. 6, 7 and 8 are schematic illustrations respectively of third, fourth and fifth embodiments of an antenna equipped with a filtering coating, FIG. 9 is a graph illustrating the development of the directivity of the antennas of FIGS. 5 and 6 as a function of the working frequency $f_T$, FIGS. 10 and 11 are radiation patterns of an antenna without a filtering coating, FIGS. 12 and 13 are radiation patterns of the antenna of FIG. 5, FIGS. 14 and 15 are radiation patterns of the antenna of FIG. 6, FIG. 16 is a schematic perspective illustration of an interlaced multi-beam antenna, FIG. 17 is a schematic illustration of a dispersion diagram of the guided propagation modes of the antenna of FIG. 16, FIG. 18 is a schematic illustration of a system for emitting interlaced beams towards the surface of the Earth, and FIG. 19 is a schematic, perspective, cut away illustration of a cylindrical antenna equipped with a filtering coating.

In these figures, the same references are used to designate the same elements.

In the rest of this description, the characteristics and functions which are well known to the person skilled in the art are not described in detail. In particular, for more information about PBG materials, the person skilled in the art can refer to the text of the patent application published under number EP 1 145 379.

FIG. 1 shows a flat waveguide 2, and FIG. 2 shows the dispersion diagram of this guide 2. FIGS. 1 and 2 are known, and are introduced here only as a reminder of the definition of certain technical terms.

The guide 2 is formed of a reflector plane 4 which extends parallel to a horizontal plane XY, which is defined by two orthogonal directions X and Y. The plane 4 reflects 100% of the electromagnetic waves at frequency $f_T$ which are propagated perpendicularly to its surface. For example, the plane 4 is implemented in metal.

The direction perpendicular to the directions X and Y is denoted as Z.

Above the plane 4, a horizontal partly reflecting wall 6 is arranged. "Partly reflecting" here means a wall which reflects strictly less than 100% and more than 80% of the electromagnetic waves of frequency $f_T$ which are propagated perpendicularly to one of the horizontal faces of this wall 6. The wall 6 is separated from the reflector 4 by a space 8 of constant height h. This space is filled with air, for example. The height h is measured in direction Z.

A wavy arrow 10 represents a guided electromagnetic wave which is propagated in the space 8. Here, the propagation direction of the waves is parallel to direction Y.

The dotted arrows 11 represent the electromagnetic waves which escape from the space 8 via the wall 6, which is only partly reflecting.

The transverse dimensions, i.e. perpendicular to the propagation direction, are assumed to be infinite in the case of a flat waveguide.

FIG. 2 shows the dispersion diagram of the waveguide 2. The constant β represents the propagation constant of a mode which is propagated parallel to the reflector 4.

The ordinate axis represents the frequency of the electromagnetic wave which is propagated in the space 8.

In a flat waveguide, only certain propagation modes can be established as a function of the frequency of the wave to be propagated. These propagation modes are classically known by the terminology of mode EMT (electric magnetic transverse) of mode $ET_n$ (electric transverse of order n) and $MT_n$ (magnetic transverse of order n), where n is an integer greater than or equal to zero. For more information on the propagation modes which are likely to be established in a flat waveguide, it is possible to refer to different course books which deal with the subject.

In FIG. 2, a straight line 12 through the origin represents the value of the constant β for every frequency of the guided wave in the case that the propagation mode is mode EMT.

A curve 14 represents the value of the constant β for every possible frequency of the guided wave in the case where the propagation mode is mode $ET_1$ or $MT_1$.

The curve intersects the frequency axis for a frequency $f_c$, known by the term "cutoff frequency".

The cutoff frequency for modes $ET_1$ and $MT_1$ is defined by the following relation:

$$f_c = \frac{2n\pi + \varphi_1 + \varphi_2}{4\pi h} c \tag{1}$$

where:

- n is the positive or negative integer such that $f_c$ takes its smallest positive non-zero value,
- $\phi_1$ is the phase shift which is introduced between an incident electromagnetic wave at frequency $f_T$ and the reflected wave after reflection on the reflector 4,
- $\phi_2$ is the phase shift which is introduced between an incident electromagnetic wave at frequency $f_T$ and the reflected wave after reflection on the wall 6,
- c is the celerity or phase velocity of the wave in the space 8.

According to the dispersion diagram, if the frequency $f_T$ is strictly less than the frequency $f_c$, the guided wave can be propagated within the space 8 only according to mode EMT.

If the frequency $f_T$ is greater than or equal to the frequency $f_c$, the guided wave can be propagated within the space 8 according to mode EMT, $ET_1$ or $MT_1$.

These modes, which enable propagation of an electromagnetic wave at frequency $f_T$ in one propagation direction, are called guided modes here. Conversely, those excitation modes of the space 8 which do not enable propagation of electromagnetic waves are called evanescent modes. An evanescent mode is characterized by the fact that the amplitude of the guided wave decreases very rapidly in the propagation direction, so that this wave cannot be propagated over a distance greater than 2λ, where λ is the wavelength of the electromagnetic wave of frequency $f_T$ in the substance which fills the space 8.

The evanescent modes of the guide 2 correspond to functional modes for which a maximum of electromagnetic energy is dissipated in the form of radiation in space, having passed through the wall 6.

FIG. 3 shows an antenna 20, which is designed to emit or receive electromagnetic waves at the working frequency $f_T$. This antenna 20 includes a resonator, which is formed of:

- a reflector 22 in plane form, which extends parallel to a horizontal plane XY defined by orthogonal directions X and Y,
- a partly reflecting wall 24, which is arranged above the reflector plane 22 in a perpendicular direction Z to directions X and Y, and extends parallel to the XY plane.

The reflector plane 22 is chosen to reflect 100% of the electromagnetic waves of frequency $f_T$ which are propagated perpendicularly to this plane. For example, the reflector plane 22 is implemented in metal, and can be connected to a reference potential such as earth.

The wall 24 here is designed to reflect strictly less than 100% and more than 80% of the electromagnetic waves of frequency $f_T$ which are propagated in a perpendicular direction to this wall. For this purpose, in this example, the wall 24 is a PBG material. PBG materials have a broad non-passing band B. When an electromagnetic wave of a frequency in the non-passing band B strikes this PBG material, it is reflected almost in total. Here, therefore, the substance forming the wall 24 is chosen so that the working frequency $f_T$ is in the non-passing band of this PBG material.

Additionally, to be able to reflect partly the electromagnetic waves which are propagated in direction Z, the PBG material which forms the wall 24 has at least one periodic alternation of two substances in direction Z. For this purpose, here, the wall 24 is formed by superimposing three flat layers 26, 28 and 30 in direction Z. Here, the layers 26 and 30 differ from the layer 28 in their permittivity. For example, the layers 26 and 30 are implemented in aluminium, whereas the layer 26 is a layer of air. The dimensions of these layers in directions X and Y are chosen to be several times greater than the wavelength $\lambda_a$, where $\lambda_a$ is the wavelength of electromagnetic waves of frequency $f_T$ in air. For example, the lateral dimensions of the layers 26, 28 and 30 are chosen to be greater than four times $\lambda_a$.

The wall 24 thus has a lower face 32 facing the reflector plane 22, and an upper face 34 opposite the lower face 32.

The lower face 32 is separated from the reflector 22 by a constant height $h_1$. The space which is thus created between the lower face 32 and the upper face of the reflector 22 forms a cavity 36.

In FIG. 3, only part of the wall 24 has been shown, to leave a large part of the interior of the cavity 36 visible.

An excitation probe 38 is arranged within the cavity 36 on the reflector 22, or in the plane of the reflector 22. In the XY plane, the probe 38 is arranged approximately at the centre of the cavity 36. This probe is capable of receiving or injecting into the cavity 36, at the reflector 22, electromagnetic fields at frequency $f_T$.

Finally, the antenna 20 includes a filtering coating 40, which covers the whole of the upper face of the reflector 22 which is within the cavity 36. The coating 40 thus surrounds the probe 38 without covering it.

This coating 40 is implemented in a suitable substance for preventing propagation of electromagnetic waves of frequency $f_T$ in a parallel direction to the XY plane, while permitting propagation of the same waves in direction Z. For this purpose, for example, the coating 40 is implemented in a PBG material which has a periodicity in two non-colinear directions of the XY plane. The periodicity of a PBG material in a direction is, for example, defined in the patent application filed under number FR 99 14521.

Here, the coating 40 has a periodicity in direction X and a periodicity in direction Y.

In this embodiment, the coating 40 is formed of vertical studs 42, which are arranged at regular intervals pin directions X and Y. These studs 42 are implemented in the same substance as is used for the reflector 22, i.e. here in metal. Another substance forming the coating 40 fills the whole of the intervals between the studs 42. This other substance here is air, i.e. an identical substance to that which fills the cavity 36.

The length of the interval p is chosen as a function of the wavelength $\lambda_a$, in such a way as to filter the electromagnetic waves of frequency $f_T$ which are propagated in directions X and Y. For this purpose, typically, the length of the interval p is less than $\lambda_a/2$ and preferably between $\lambda_a/4$ and $\lambda_a/2$.

The height $h_p$ of the studs 42 in direction Z must be strictly less than the height $h_1$. For example, here, the height $h_p$ is chosen to be strictly less than $\lambda_a/2$ and preferably equal to $\lambda_a/4$ plus or minus 15%.

Here, the transverse cross-section of the studs 42, i.e. a parallel cross-section to the XY plane, is square. The greatest width of this transverse cross-section is chosen to be less than $\lambda_a/8$.

Finally, the height $h_1$ is chosen using relation (1) so that the cutoff frequency $f_c$ is equal to or slightly greater than the frequency $f_T$. Typically, it is arranged here that the ratio of the frequency $f_T$ to the frequency $f_c$ is between 0.85 and 1.

FIG. 4 shows the dispersion diagram of the antenna 20.

As in FIG. 2, the curves 50 and 52 represent the frequency of the guided wave, according to the mode EMT and the modes $ET_1$ or $MT_1$ respectively, as a function of the propagation constant $\beta$.

Because of the presence of the coating 40, the curve 50 approaches an asymptotic value C, represented by a dotted horizontal line 54, as the constant $\beta$ increases. This asymptotic value C is independent of the height $h_1$.

Here, the height $h_1$ of the cavity 36 is chosen so that the frequency $f_T$ is between the frequency $f_c$ and the value C. In these conditions, it is understood that no guided mode can be established within the cavity 36 when the latter is excited by a magnetic field of frequency $f_T$. Thus only evanescent modes appear, and the energy of the electromagnetic field which is introduced by the probe 38 into the cavity 36 is dissipated almost exclusively in the form of radiation, after having passed through the wall 24. The effect of this is an increase of the directivity of the antenna 20 in relation to an identical antenna, but without the filtering coating such as the coating 40.

FIG. 5 shows an antenna 60, which is identical to the antenna 20 except that the wall 24 is replaced by a partly reflecting wall 62.

The wall 62 is implemented here not using a PBG material, but using a grating 62 which is formed of metallic bars which extend parallel to each other in a parallel plane to the XY plane. More precisely, here, the grating 62 includes, on the one hand, bars 66 which are arranged at regular intervals mand all extend parallel to direction X, and on the other hand, bars 68 which are arranged parallel to each other in direction Y at regular intervals m. The length of the interval mis chosen to be strictly less than $\lambda_a/2$, so that this grating 62 partly reflects the electromagnetic waves of frequency $f_T$ which are propagated in direction Z. Preferably, mis less than $\lambda_a/4$.

In the same way as for the antenna 20, the height $h_1$ of the cavity 36 is chosen so that the cutoff frequency $f_c$ is slightly greater than the frequency $f_T$. In these conditions, the functioning of the antenna 60 is similar to that of the antenna 20.

FIG. 6 shows an antenna 70, which is identical to the antenna 60 except that the cavity 36 is insulated from the outside of the antenna by lateral walls 72. In FIG. 6, only part of the wall 72, which entirely surrounds the cavity 36, has been shown, to leave the inside of the cavity 36 visible.

The wall 72 extends in direction Z from the reflector 22 to the lower face of the grating 62. For example, the wall 72 is implemented here in a metallic substance which reflects all the electromagnetic waves of frequency $f_T$.

FIG. 7 shows an antenna 80, which is identical to the antenna 70 except that the grating 62 is replaced by a grating 82. The grating 82 is identical to the grating 62, except that the bars 68 have been omitted. Such a grating 82 forms a partly reflecting wall only for electromagnetic waves of frequency $f_T$ with a given polarisation. For electromagnetic waves with a different polarisation from this, the grating 82 forms a transparent wall, which does not reflect or only slightly reflects the electromagnetic waves of frequency $f_T$ with a different polarisation. Thus the grating 82 makes it possible to carry out polarisation filtering on the emitted or received waves.

FIG. 8 shows an antenna 90, which is identical to the antenna 70 except that the walls 72 are replaced by walls 92. More precisely, the walls 92 are identical to the walls 72 except that they include corrugations 94, which make it possible to improve the performance of the antenna. These corrugations 94 are designed in the same way as those which can be found in certain types of waveguide. For example, the design of these corrugations is described in the following document:

Antenna theory, Analysis and design—Constantine A. Balanis—John Wiley.

FIG. 9 shows two curves 100 and 102, corresponding to the change in the directivity of the antennas 60 and 70 respectively as a function of the frequency $f_T$. FIG. 9 also shows a curve 104, which indicates the development of the directivity of an identical antenna to the antenna 60, but without the filtering coating 40.

In the graph of FIG. 9, the abscissa axis represents the ratio of the frequency $f_T$ to the cutoff frequency $f_c$. The ordinate axis represents the maximum directivity expressed in decibels (dB). The curves 100, 102 and 104 were obtained using an identical probe, that is in this case a slot which is made in the plane of the reflector 22, and by which the electromagnetic field of frequency $f_T$ is introduced into the cavity 36.

As can be seen in the graph, the directivity of the antennas 60 and 70 is systematically improved when the frequency $f_T$ is less than the frequency $f_c$.

FIGS. 10 and 11 show radiation patterns in the planes E and H respectively of an identical antenna to the antenna 60, but without the filtering coating 40.

FIGS. 12 and 13 show radiation patterns in the planes E and H respectively of the antenna 60, in the particular case where the ratio of the frequency $f_T$ to the frequency $f_c$ equals 0.997.

Finally, FIGS. 14 and 15 show radiation patterns in the planes E and H respectively of the antenna 70, in the particular case where the ratio of the frequency $f_T$ to the frequency $f_c$ equals 1.007.

In these different graphs of FIGS. 10 to 15, the abscissa axis is graduated in degrees, and the ordinate axis is graduated in decibels (dB).

As is shown by comparing the graphs of FIGS. 12 and 13 with the graphs of FIGS. 10 and 11, the presence of the filtering coating makes it possible to attenuate the secondary lobes of the antenna considerably.

Also, as is shown by comparing the graphs of FIGS. 14 and 15 with those of FIGS. 10 and 11, this attenuation of the secondary lobes occurs even if the frequency $f_T$ is greater than the frequency $f_c$.

In the preceding embodiments, the antenna was formed of a single resonator. However, it can be particularly advantageous to superimpose two resonators, to create a multi-beam antenna in which the radiating patches partly overlap. Such an antenna 120 is shown in FIG. 16.

The antenna 120 is formed of a first resonator 122 on which a second resonator 123 is superimposed.

For example, the resonator 122 is identical to any one of the resonators of the antennas 20, 60, 70, 80 or 90, except that it includes several excitation probes. Here, it will be assumed that the resonator 122 is identical to that of the antenna 20, in which the probe 38 is replaced by five excitation probes 124 to 128.

The probes 124 to 128 are chosen so that they form a surface for injection or reception of electromagnetic fields inside the cavity 36. The greatest width of each of the, injection or reception, surfaces is greater than or equal to $\lambda_a$. More precisely, the distribution of the power of the electromagnetic field on the injection or reception surface has a point where the power is maximum, this point being distant from the periphery of this injection surface. The power of the electromagnetic field of this injection surface is distributed in such a way that the power decreases continuously along an arbitrary straight line going from the point where the power is maximum to the periphery of this surface. A probe with such an injection surface makes it possible to increase the directivity of the antenna and its gain. For this purpose, for example, the probes 124 and 128 are flared waveguides, the ends of which open into an aperture which is made in the plane of the reflector 22. Such flared waveguides are, for example, those described in the patent application which was lodged on 25 Sep. 2006 under number 06 08381, in the name of C.N.R.S.

Here, each of the probes 124 to 128 works at a respective frequency $f_{Ti}$ which is different from that of the others, so that these probes can work simultaneously without interfering with each other. Each of these frequencies is chosen to be near enough to the frequency $f_T$ so that the coating 40, which is designed to filter the electromagnetic waves of frequency $f_T$, is equally effective for filtering the waves of frequency $f_{Ti}$. For this purpose, the ratio of the frequency $f_{Ti}$ to the frequency $f_T$ is between 0.95 and 1.05.

To simplify FIG. 16, the filtering coating 40 has not been shown.

The resonator 123 is arranged above the resonator 122 in direction Z. This resonator 123 is formed by an upper radiating wall 132 and the wall 24. The wall 24 thus simultaneously forms the upper wall of the resonator 122 and the lower wall of the resonator 123.

The wall 132 reflects strictly less than 100% and more than 80% of the electromagnetic waves at frequency $f_T$ which are propagated perpendicularly to this wall. Preferably, the reflectivity of the wall 132 is strictly less than that of the wall 124.

The wall 132 extends parallel to the XY plane. The wall 132 is separated from the upper face of the wall 24 by a constant height $h_2$. Thus a cavity 136 is created between the wall 24 and the wall 132. In this embodiment, the cavity 136 is filled with air, for example.

The substance which forms the wall 132 can be a PBG material, as described with respect to FIG. 3, or a grating, as described with respect to FIGS. 5 and 7.

The height $h_2$ is chosen so that the cavity 136 is a leaking resonant cavity. For this purpose, the height $h_2$ is less than $\lambda_a/2+\lambda_a/20$. Preferably, the height $h_2$ is determined using the following relation:

$$h_2 = (2n\pi + \varphi_1 + \varphi_2)\frac{\lambda_a}{4\pi} \tag{2}$$

where:

- n is the positive or negative integer which makes it possible to obtain the smallest positive height $h_2$,
- $\phi_1$ is the phase shift which is introduced between an incident electromagnetic wave at frequency $f_T$ and the reflected wave after reflection on the upper face of the partly reflecting wall of the first resonator,
- $\phi_2$ is the phase shift which is introduced between an incident electromagnetic wave at frequency $f_T$ and the reflected wave after reflection on the lower face of the radiating wall, $\lambda_a$ is the wavelength of the electromagnetic wave of frequency $f_T$ in the substance which fills the leaking resonant cavity.

When the height $h_2$ is defined by the relation (2), the cutoff frequency $f_{c2}$ of the propagation modes $ET_1$ and $MT_1$ of the resonator 123 equals the frequency $f_T$. In these conditions, the gain of the resonator 123 is maximum.

It should be remembered that in contrast, the height $h_1$ of the resonator 122 is chosen so that the cutoff frequency, here called $f_{c1}$, of the propagation modes $ET_1$ or $MT_1$ is strictly greater than the frequency $f_T$.

Finally, in contrast to the resonator 122, the cavity 136 has no coating to filter the electromagnetic waves which are propagated in any direction parallel to the XY plane. In fact, as will be understood on reading the explanations below, such a filtering coating is unnecessary in the resonator 123.

FIG. 17 shows the dispersion diagram of the resonators 122 and 123. In this FIG. 17, the curves 150 and 152 correspond respectively to the curves 50 and 52 of FIG. 4 for the resonator 122. The curves 154 and 156 show the development of the frequency of the guided wave, according to the modes EMT and $ET_1$ or $MT_1$ respectively, as a function of the propagation constant β. The curves 154 and 156 have approximately the same shape as the curves 12 and 14 and those of a flat waveguide.

In this figure, the cutoff frequencies of the modes $ET_1$ or $MT_1$ of the resonators 122 and 123 are called $f_{c1}$ and $f_{c2}$ respectively. The asymptotic value which the curve 150 approaches as the constant βincreases, is called $C_1$ here. It should be remembered that this curve 150 approaches a value $C_1$, less than the frequency $f_T$, because of the presence of the filtering coating 40 inside the cavity 36. On the other hand, the curve 154 does not approach an asymptotic value as the constant β increases, because the cavity 136 has no filtering coating.

The frequencies $f_{Ti}$ are near the frequency $f_T$, which here is itself approximately equal to the frequency $f_{c2}$. In these conditions, it is understood from the diagram of FIG. 17 that the electromagnetic fields of frequencies can only excite an evanescent propagation mode in the first resonator 122, since these frequencies $f_{Ti}$ are each greater than the value C, and strictly less than the frequencies $f_{c1}$. Thus almost all the energy of the electromagnetic fields which are introduced into the cavity 36 is radiated by the upper face of the wall 24. The effect of this radiation is the appearance, on the vertical line of each of the probes 124 to 128, of an excitation patch. The excitation patches corresponding to the probes 124 to 128 are shown in FIG. 16, and have the references 160 to 164 respectively. An excitation patch is defined as being formed by all the points of the upper surface 34 of the wall 24 around a point of this face, where the intensity of the emitted electromagnetic field is maximum, and including all the points of this face where the intensity of the electromagnetic field which this probe emits is greater than or equal to half this maximum intensity.

Thus these patches 160 to 164 inject magnetic fields at frequencies into the cavity 136, and thus each fulfils the function of an excitation probe. However, the arrangement described with respect to FIG. 16 makes it possible to inject electromagnetic fields at different frequencies into the cavity 136, without thereby modifying the reflectivity of the upper face of the wall 24. In fact, no opening is made in the upper face of the wall 24, and no projecting radiating element is introduced into the cavity 136. In these conditions, since no element or roughness which is likely to diffract the electromagnetic fields which are injected into the cavity 136 exists, the mode EMT of the resonator 123 cannot be excited. Additionally, since the frequencies $f_{Ti}$ are almost equal to the frequency $f_{c2}$, the guided modes $ET_1$ or $MT_1$ can also not appear in the cavity 136. In these conditions, the electromagnetic energy which is introduced into the cavity 136 is radiated by the upper face of the wall 132. The effect of this is the appearance, on this upper face, of radiating patches on the vertical line of each of the excitation patches. In FIG. 16, the radiating patches 166 to 170, corresponding to the excitation patches 160 to 164 respectively, are shown. These radiating patches are defined like the excitation patches, namely they group all those points of the upper surface of the wall 132 at which the intensity of the emitted electromagnetic field is greater than or equal to half the maximum emitted intensity.

Here, to create a multi-beam antenna of which the beams are interlaced, the position of the probes 124 to 128 relative to each other is chosen so that each radiating patch partly overlaps at least one other radiating patch produced by another probe. The distance between two probes is thus strictly less than the sum of the radii of their respective radiating patches. Preferably, the distance between the probes, measured in a parallel plane to the XY plane, is chosen so that the excitation patches 160 to 164 do not overlap, but on the other hand the radiating patches 166 to 170 partly overlap.

The antenna 120 is quite particularly intended to be installed in, for example, a radio telecommunication satellite.

FIG. 18 shows a system 180 for emitting electromagnetic waves, on board a geostationary satellite. This system 180 includes a device for focusing beams onto the surface of the Earth 182. For example, the focusing device is a parabola 184. The system 180 also includes the antenna 120, which is placed at the focus of this parabola 184.

In these conditions, the effect of interlacing the radiating patches on the upper face of the wall 132 is the appearance of interlaced coverage zones 186 to 190 on the surface of the Earth. The coverage zones thus partly overlap, which avoids the appearance of dead zones between two coverage zones, where establishing radio telecommunication via the geostationary satellite would be impossible, for example.

FIG. 19 shows a cylindrical antenna 200, which is similar to the antenna 20 except that the different planes forming the antenna 20 have been curved until they close on themselves to form cylindrical faces of circular cross-section instead of flat faces.

The antenna 200 here has a symmetry of revolution around an axis 201 of revolution, which extends in direction Z.

The antenna 200 includes:

- a reflector 202, which is capable of reflecting all the electromagnetic waves which are propagated perpendicularly to its surface,
- a filtering coating 204, which is arranged on the surface of the reflector 202,
- a partly reflecting wall 206, which surrounds the reflector 202 and the coating 204,
- a cavity 208, which is delimited on one side by the inner face of the wall 206, and on the other side by the outer face of the reflector 202.

Here the reflector 202 is, for example, a cylindrical bar of circular cross-section, of metal, extending along the axis 201.

The coating 54 is formed here of a succession of dielectric cylinders 212 surrounding the reflector 202 and arranged at regular intervals p along direction Z. The length of the interval p in direction Z is less than $\lambda_a/2$ and preferably equal to $\lambda_a/4$. Such a coating 204 forms a PBG material, which is suitable for eliminating the electromagnetic waves which are propagated in direction Z, but without eliminating the electromagnetic waves which are propagated in a radial direction.

The cavity 208 here is filled with air, for example.

The wall 206 is, for example, a dielectric PBG material which has at least one periodicity in a radial direction.

The inner face of the wall 206 is separated from the reflector 202 by a constant distance $R_1$. The distance $R_1$ is chosen similarly to what was described regarding the height $h_1$.

The radius of the rings 212 is chosen similarly to what was described regarding the height $h_p$ of the studs 42.

Finally, an excitation probe 214, which is suitable for injecting or receiving electromagnetic fields at frequency $f_T$, is placed inside the cavity 208 and near the reflector 202.

The antenna 200 functions similarly to what was described above, except that its main radiation lobe is annular.

Numerous other embodiments are possible. For example, the transverse section of the studs 42 does not have to be square. It can be rectangular or cylindrical, of circular cross-section or not.

The PBG material which forms the filtering coating has been described in the particular case in which it is formed of at least two different substances, of which one is the same as is used for the reflector, and the other is the same as that which fills the cavity. However, these substances do not have to be identical to those of the reflector and cavity respectively. For example, the substance which is identical to that which fills the cavity can be replaced by a foam, the permittivity of which is close to that of the substance which fills the cavity.

The PBG material which forms the coating 40 was described in the particular case in which the periodicity in directions X and Y is identical. As a variant, the periodicity in directions X and Y is not identical. Also, the directions in which the studs 42 are distributed at regular intervals do not have to be orthogonal. For example, the different studs could be arranged at the angles of a triangle or hexagon.

The PBG materials which are used to form the partly reflecting walls can have elements which differ in their permittivity arranged at regular intervals in more than two non-colinear directions. In these conditions, these PBG materials are said to be multi-dimensional.

The PBG materials used here are formed of at least two different substances. These two substances can differ from each other in their permeability and/or permittivity and/or conductivity.

The embodiments of FIGS. 3, 6 and 8 can be combined. For example, the antenna 20 can be provided with a lateral wall which is similar to the lateral wall 72 or the lateral wall 92.

In the case of an antenna which includes several excitation probes, simultaneous functioning of these different probes can also be obtained when each of the probes injects or receives only electromagnetic fields which have a different polarisation from that of the other probes of the same antenna.

If elements which are likely to diffract the electromagnetic field which is injected into the cavity 136 exist, it is possible to arrange a filtering coating on the upper face of the wall 24. This filtering coating is then identical to the filtering coating 40, for example.

The excitation probes can be any types of probe which are likely to inject an electromagnetic field into the inside of a cavity. For example, these probes can be flared cones, a patch antenna, a slot or other antenna or a coupling diaphragm between a waveguide and the cavity 36 or 122.

The reflector is not necessarily implemented in metal. It can also be implemented in any other substance or arrangement of substances which has a reflectivity of practically 100% for electromagnetic waves of frequency $f_T$ when these are propagated perpendicularly to the face of this reflector.

Finally, if a misaligned antenna is desired, i.e. one of which the maximum directivity is not perpendicular to its radiating outer face, it is possible to choose the height $h_1$ or the radius $R_1$ so that the cutoff frequency is strictly less than the frequency $f_T$.

Finally, as a variant, the filtering coating of the resonator 122 is omitted, so that none of the resonators of the antenna 120 includes a filtering coating such as the coating 40. The functioning of the antenna 120 is nevertheless improved, because the magnetic field is injected into the second resonator 123 by excitation patches, which does not modify the reflectivity of the upper face of the wall 24.

The invention claimed is:

1. Antenna designed to emit or receive electromagnetic waves at a working frequency $f_T$, this antenna including a first resonator (20; 60; 70; 80; 90; 122) formed of:

a reflector (22) reflecting all the electromagnetic waves at frequency $f_T$ which are propagated perpendicularly to this reflector, a partly reflecting wall (24), through which the electromagnetic waves at frequency $f_T$ pass, this wall reflecting strictly less than 100% and more than 80% of the electromagnetic waves at frequency $f_T$ which are propagated perpendicularly to this wall, a cavity (36) which is delimited on one side by an upper face of the reflector, and on the other side by a lower face of the partly reflecting wall, and at least one excitation probe (38; 124-128) for the cavity, suitable for receiving or injecting into this cavity, at the reflector, electromagnetic fields at frequency $f_T$, characterised in that the first resonator includes a filtering coating (40) which covers the majority of the upper face of the reflector within the cavity, this coating being suitable for eliminating all electromagnetic waves of frequency $f_T$ which are propagated in a parallel direction to the upper face of the reflector, but without eliminating all electromagnetic waves at frequency $f_T$ which are propagated in a perpendicular direction to the upper face of the reflector, and in that the filtering coating (40) forms a PBG (photonic band gap) material which includes at least a first and a second substance, which differ in their permittivity and/or permeability and/or conductivity, and are arranged alternately at regular intervals only along one or more parallel directions to the upper face of the reflector, the regular interval being a function of the wavelength $\lambda_1$ of the electromagnetic waves of frequency $f_T$ in the first substance, in such a way as to eliminate the electromagnetic waves of frequency $f_T$ which are propagated parallel to the upper face of the reflector.

2. Antenna according to claim 1, wherein the first substance forming the filtering coating (40) is identical to the substance which fills the cavity.

3. Antenna according to claim 1, wherein the second substance forming the coating (40) is identical to the substance forming the upper face of the reflector.

4. Antenna according to claim 3, wherein the second substance forms studs (42), of which the greatest width extends in a perpendicular direction to the upper face of the reflector (22), these studs being distributed at regular intervals on the upper face of the reflector, in two directions which are non-colinear and parallel to this upper face, the greatest width being strictly less than $\lambda_1/2$, where $\lambda_1$ is the wavelength of the electromagnetic waves of frequency $f_T$ in the first substance.

5. Antenna according to claim 1, wherein the upper face of the reflector and the lower face of the partly reflecting wall are separated from each other by a height $h_1$ which is constant and strictly less than or equal to $\lambda_2/2$, where $\lambda_2$ is the wavelength of the electromagnetic waves of frequency $f_T$ in the substance which fills the cavity.

6. Antenna according to claim 1, wherein the partly reflecting wall is a grating (62) formed of multiple parallel metallic bars (66, 68), the shortest distance between two contiguous parallel bars being strictly less than $\lambda_3/2$, where $\lambda_3$ is the wavelength of the electromagnetic waves of frequency $f_T$ in air.

7. Antenna according to claim 1, wherein the partly reflecting wall is a PBG material which includes at least two substances (26, 28, 30), which differ in their permittivity and/or permeability and/or conductivity, and are arranged alternately at least along a perpendicular direction to the upper face of the reflector, one of these two substances being the same as that which fills the cavity.

8. Antenna according to claim 1, wherein the antenna includes a second resonator (123) formed of:

a radiating wall (132), through which electromagnetic waves pass at frequency $f_T$, and having a radiating outer face, this radiating wall reflecting strictly less than 100% and more than 80% of the electromagnetic waves at frequency $f_T$ which are propagated perpendicularly to this radiating wall, a leaking resonating cavity (136), delimited on one side by a lower face of the radiating wall, and on the other side by an upper face of the partly reflecting wall (24) of the first resonator, the radiating wall and the partly reflecting wall being separated from each other by a height $h_2$ which is constant and less than or equal to $\lambda_4/2+\lambda_4/20$, where $\lambda_4$ is the wavelength of the electromagnetic waves of frequency $f_T$ in the substance which fills the leaking resonating cavity.

9. Antenna according to claim 8, wherein the antenna includes multiple excitation probes (124-128) in the first resonator (122), each causing the formation of an excitation patch (160-164) on the upper face of the partly reflecting wall, each excitation patch in its turn creating a radiating patch (166-170) on the radiating face of the radiating wall, each excitation patch and radiating patch being defined as being the zone of the upper face of the partly reflecting wall (24) and radiating wall (132) respectively, located around a point of this face where the intensity of the electromagnetic field emitted by this probe is maximum, and including all the points of this face where the intensity of the electromagnetic field emitted by this probe is greater than or equal to half this maximum intensity, and in which the distance separating two contiguous excitation probes is chosen to be sufficiently small for the radiating patches created by these probes to overlap partly.

10. Antenna according to claim 1, wherein each excitation probe (124-128) has a surface for injection and/or reception of electromagnetic waves at frequency $f_T$, the greatest width of which is greater than or equal to $\lambda_2$, the power distribution of the electromagnetic waves on the injection surface and/or reception surface having a point at which the power is maximum, this point being distant from the periphery of this surface, and the power decreases continuously along a straight line going from this point to the periphery, irrespective of the direction of the straight line considered in the plane of this surface, $\lambda_2$ being the wavelength of the electromagnetic waves of frequency $f_T$ in the substance which fills the cavity of the first resonator.

11. Antenna according to claim 8, wherein the height $h_2$ is given by the following relation:

$$h_2 = (2n\pi + \varphi_1 + \varphi_2)\frac{\lambda_4}{4\pi}$$

where:

n is the positive or negative integer which makes it possible to obtain the smallest positive height $h_2$, $\phi_1$ is the phase shift which is introduced between an incident electromagnetic wave at frequency $f_T$ and the reflected wave after reflection on the upper face of the partly reflecting wall of the first resonator, $\phi_2$ is the phase shift which is introduced between an incident electromagnetic wave at frequency $f_T$ and the reflected wave after reflection on the lower face of the radiating wall, $\lambda_4$ is the wavelength of the electromagnetic wave of frequency $f_T$ in the substance which fills the leaking resonant cavity.

12. Antenna according to claim 11, wherein the upper face of the reflector (22) and the lower face of the partly reflecting wall (24) are separated from each other by a height $h_1$ which is constant and strictly less than or equal to $\lambda_2/2$, where $\lambda_2$ is the wavelength of the electromagnetic waves of frequency $f_T$ in the substance which fills the cavity of the first resonator.

13. Antenna according to claim 1, wherein the cavity (36) of the first resonator forms a waveguide, which has a cutoff frequency $f_c$, of the propagation mode $ET_1$ or $MT_1$, and an asymptotic value C above which no propagation mode EMT can be established, and in which the frequency $f_T$ is less than or equal to the frequency $f_c$, and greater than the asymptotic value C.

14. System for emitting or receiving electromagnetic waves, including:

a focusing device (184), which is capable of focusing the electromagnetic waves which the system emits or receives onto a focal point, and an antenna (120) for emitting or receiving electromagnetic waves, placed on this focal point, characterised in that the antenna is in accordance with claim 9.

15. Antenna according to claim 2, wherein the second substance forming the coating (40) is identical to the substance forming the upper face of the reflector.

* * * * *